US005319615A

United States Patent [19]

Ng

[11] Patent Number: 5,319,615

[45] Date of Patent: Jun. 7, 1994

[54] WATCH WITH SLIDABLE DECORATIVE INDICIA

[76] Inventor: Chak W. W. Ng, 34312 Mulberry Ter., Fremont, Calif. 94555

[21] Appl. No.: 136,356

[22] Filed: Oct. 14, 1993

[51] Int. Cl.[5] ..... G04B 37/00; G04B 47/04

[52] U.S. Cl. ..... 368/276; 368/285; 368/309

[58] Field of Search ..... 368/276, 285, 294–296, 368/309

[56] References Cited

U.S. PATENT DOCUMENTS

| | | | |
|---|---|---|---|
| 2,838,905 | 6/1958 | Marble | 368/276 |
| 4,253,178 | 2/1981 | Kolaczia | 368/285 |
| 4,473,304 | 9/1984 | Ketner | 368/281 |
| 4,525,077 | 6/1985 | Ketner | 368/77 |

*Primary Examiner*—Vit W. Miska

*Attorney, Agent, or Firm*—Caesar, Rivise, Bernstein, Cohen & Pokotilow, Ltd.

[57] ABSTRACT

A watch having a face and a case of circular profile surrounding the face. The case includes a circular raceway and a plurality of separate decorative inserts, each in the shape of a linguistic element, e.g., a letter of the alphabet or a symbol, e.g., a heart, denoting a word or a concept. The raceway is disposed under a transparent bezel immediately adjacent the periphery of the case. The inserts are arranged to be slidably mounted in the raceway in any predetermined order to establish a predetermined message, e.g., a person's name, so that the message carried by the insert can be slid about the entire circumference of the case to be displayed at any orientation. The inserts are held in a predetermined orientation, i.e., their tops are directed radially away from the center of the watch so that the message is readily readable irrespective of its location along the periphery of the watch.

11 Claims, 3 Drawing Sheets

WATCH WITH SLIDABLE DECORATIVE INDICIA

BACKGROUND OF THE INVENTION

This invention relates generally to watches, and more particularly to watches having decorative features, and more particularly to watches for displaying a message utilizing movable decorative linguistic elements.

Various watches, e.g., wrist watches, pendant watches, an the like, are commercially available for displaying a message thereon. Such watches typically bear the message on the dial or face of the watch. While such watches are generally suitable for their intended purposes they leave much to be desired from the standpoints of aesthetics and ability to customize the message without changing the face of the watch.

Some watches have included real or simulative gemstones slidably mounted within a raceway or track extending about the periphery of the watch case for the gemstones. The gemstones are mounted within the raceway so that they can move orbitally, i.e., rotate about their own center point while they slide along the circular raceway. While these watches are aesthetically pleasing they still leave something to be desired from the standpoint of aesthetics.

OBJECTS OF THE INVENTION

Accordingly, it is a general object of this invention to provide a watch which addresses those needs.

It is another object of this invention to provide a watch which includes means for providing a custom message about the periphery of the watch's case.

It is another object of this invention to provide a watch which provides a custom message within a raceway surrounding the case so that the message can be located at any peripheral position.

SUMMARY OF THE INVENTION

These and other objects of this invention are achieved by providing a watch having a face and a case of circular profile surrounding the face. The case includes a circular raceway and a plurality of separate decorative inserts. The raceway is mounted about the periphery of the watch's face. Selected ones of the plurality of decorative inserts are shaped to define linguistic elements, e.g., letters of an alphabet and/or symbols depicting a word or concept.

The decorative linguistic element inserts are located within the raceway in a predetermined order to establish a predetermined message, e.g., a person's name. That message is slidably in the raceway so that it may be positioned at an point along the periphery of the watch's case.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
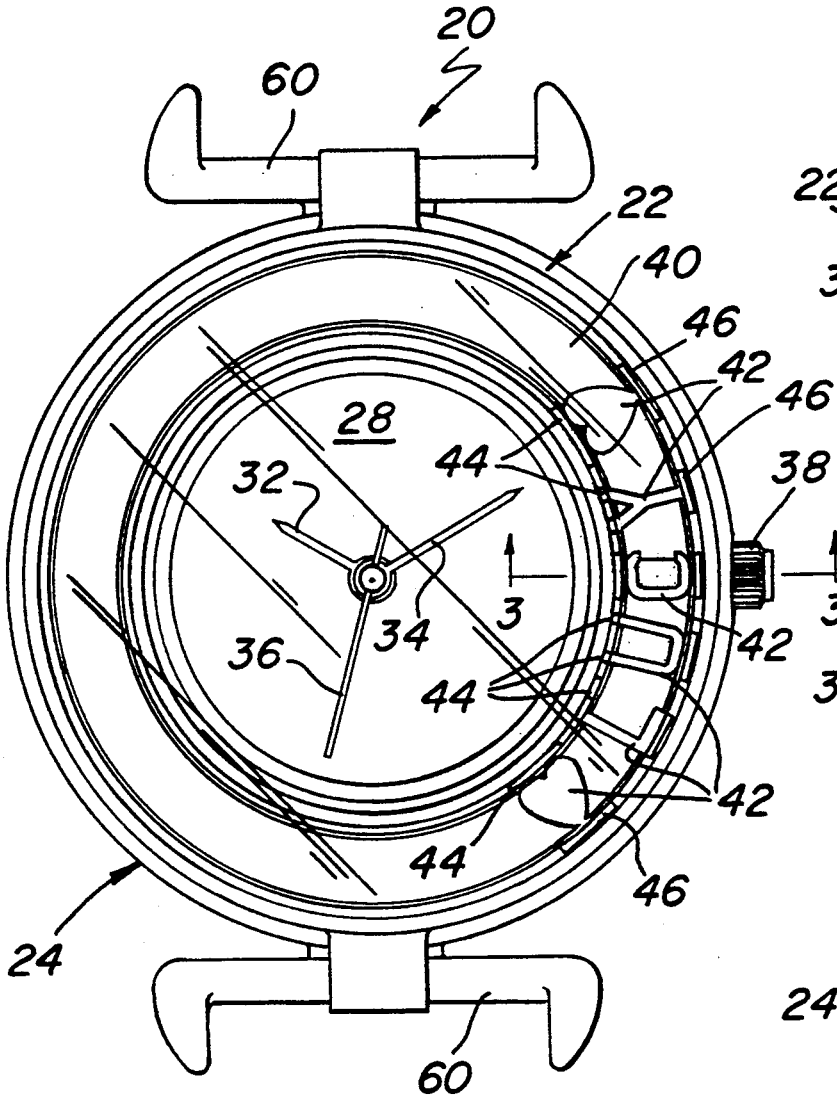
FIG. 1 is a top plan view of a watch constructed in accordance with this invention.
Figure 2:
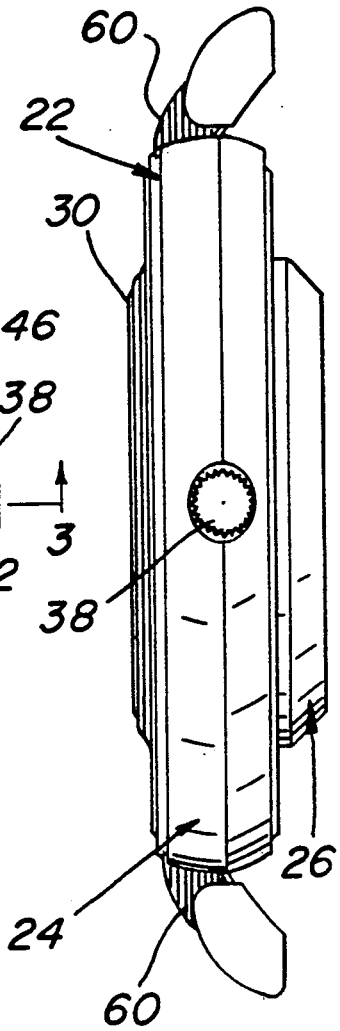
FIG. 2 is a side elevational view of the watch shown in FIG. 1.

Referring now to various figures of the drawing where like reference numerals refer to like parts there is shown at 20 in FIG. 1, a watch constructed in accordance with this invention. The watch 20 is presently the subject of a British Design application, Ser. No. 2026851, filed on Nov. 4, 1992, and entitled Wristwatch With Strap. Aside from its design appearance and the movable decorative indicia and associated components (to be described later) the watch 20 is of somewhat conventional construction. Thus, as can be seen in FIGS. 1 and 2 the watch 20 basically comprises a case 22 having a front section 24 and a rear section 26 which when connected together form a housing in which the watch works (not shown) are located. The front section of the case includes dial 28 located under a transparent crystal 30. As is conventional the watch includes an hour hand 32, a minute hand 34, and a sweep second hand 36, arranged to sweep around the dial to indicate the time. A stem 38 (FIG. 3) extends through the case for connection to the watch works (not shown) within the case to enable the watch to be wound and set.

Figure 3:
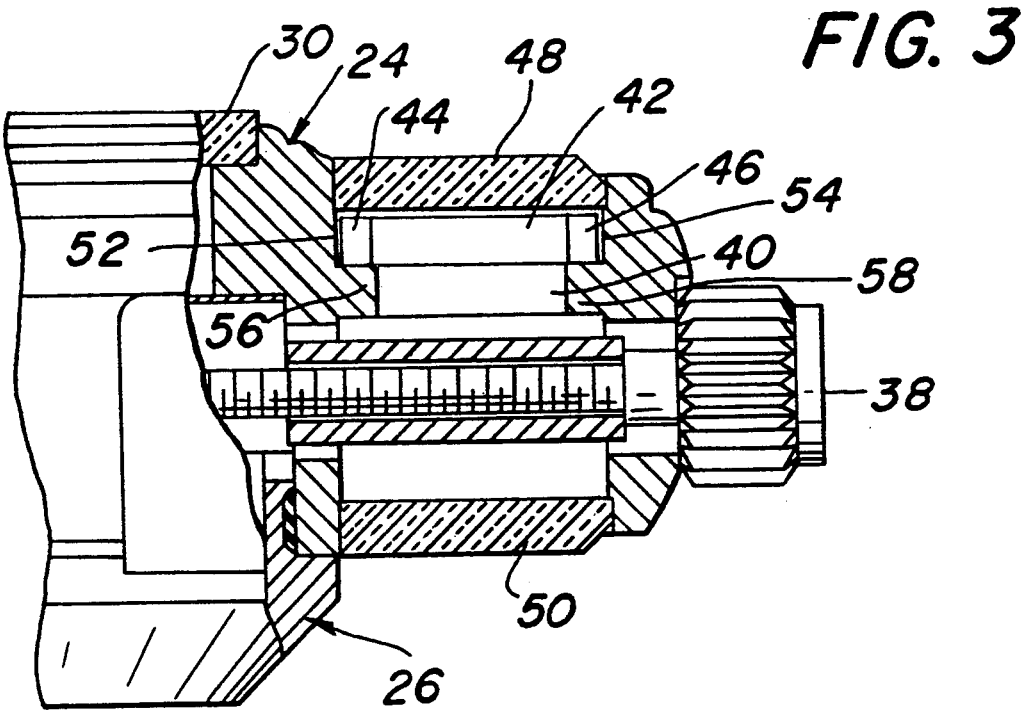
FIG. 3 is an enlarged view, partially in section, taken along line 3—3 of FIG. 1.
Figure 4:
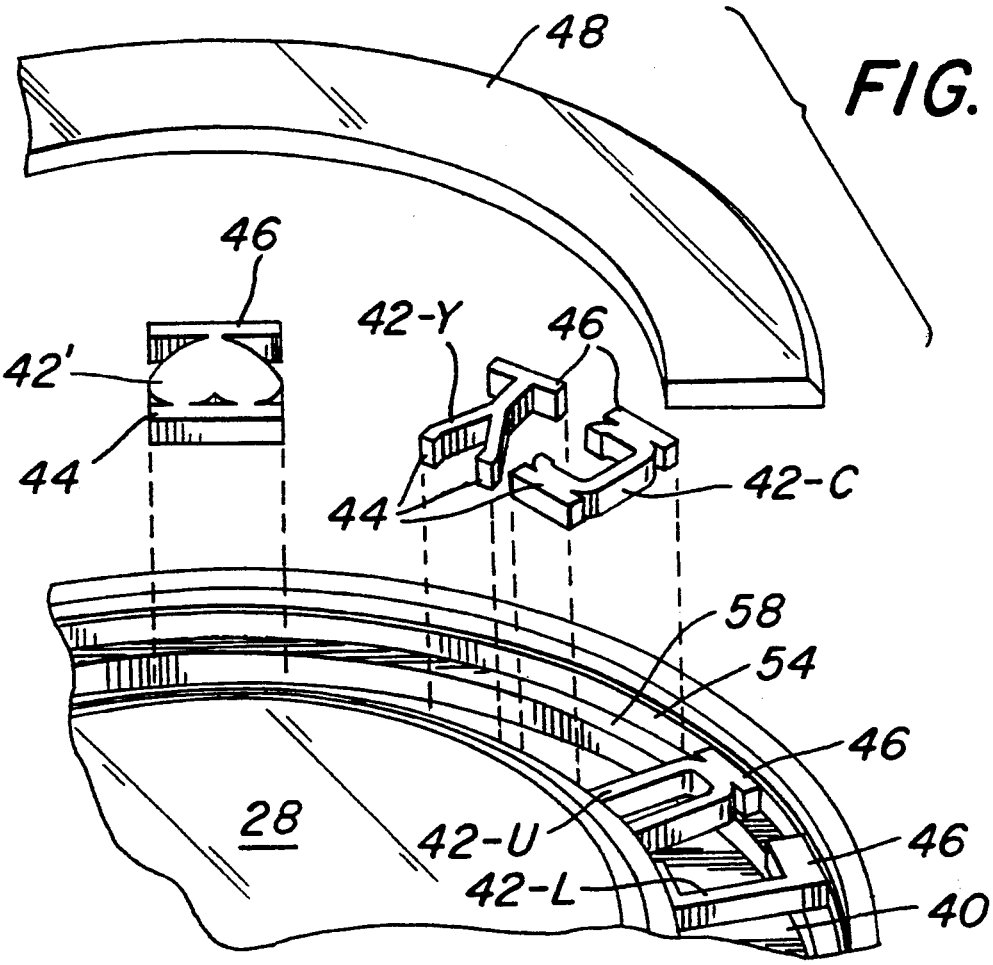
FIG. 4 is an exploded isometric view of a portion of the watch shown in FIG. 1.

In accordance with a preferred embodiment of this invention, and as can be seen clearly in FIGS. 1, 3 and 4, the front section 24 of the case includes a circular raceway 40 located therein and which is disposed about the periphery of the watch's dial 28. The details of the raceway 40 will be described later. Suffice it for now to state that the raceway is arranged to receive for sliding movement therealong a plural decorative inserts 42. Each insert is preferably in the form of a "linguistic element." By linguistic element it is meant that each insert may comprise a single letter or a group of letters from any alphabet, or may comprise a word or group of words, or may comprise a symbol, e.g., a heart, indicative of a word or a concept.

Figure 5:
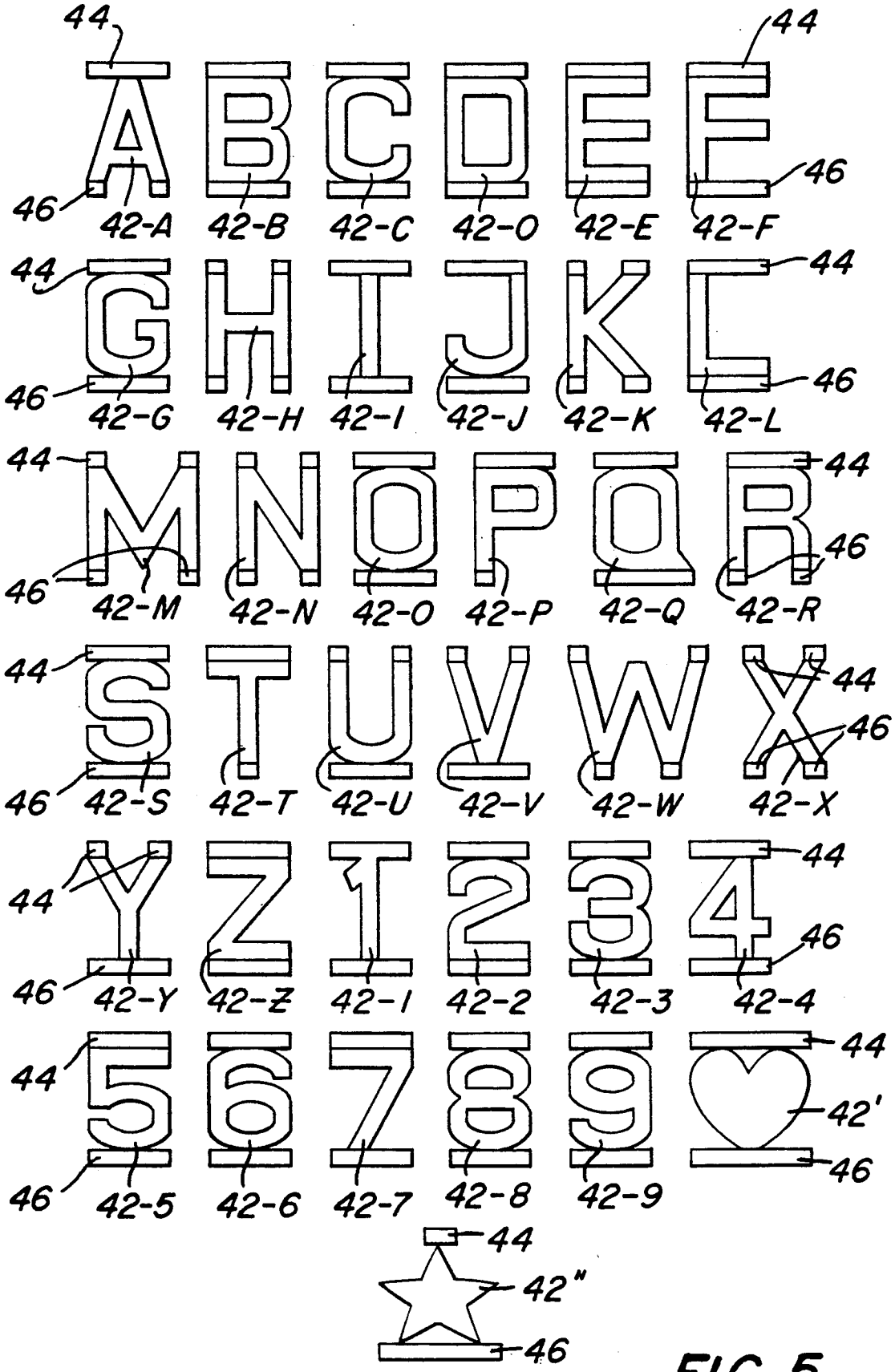
FIG. 5 is a top plan view showing a group of letters, numbers and symbols which can be used to form a decorative linguistic message in the watch of FIG. 1.

In FIG. 5 there is shown a group or character set of exemplary linguistic inserts 42, each of which represents a respective character or letter in the english language and a respective number in the arabic number system. Thus, in the embodiment of, the inserts 42 are shaped like the letters from "A" to "Z" (designated as 42-A to 42-Z, respectively, in FIG. 5) and the numbers from "1" to "9" (designated as 42-1 to 42-9, respectively, in FIG. 5). The character set also includes two inserts shaped like the well known symbols of a heart (designated by the reference number 42') and a star (designated by the reference number 42'').

As can be seen in FIG. 5, each of the inserts 42 includes a upper end in the form of one or more tabs 44 (depending upon the shape of the letter, number, or symbol), and a lower end in the form of one or more tabs 46 (also depending upon the shape of the letter, number, or symbol). The tabs 44 and 46 on each insert are provides to serve as the means for supporting that insert on an opposed pair of circular flanges, to be described later, forming a portion of the raceway 40.

Selected ones or duplicates of any the inserts 42 of the character set of FIG. 5 can be used to form the watch's message. To that end, and as will be discussed later, the selected inserts 42 are arranged in a predetermined order immediately adjacent one another within the raceway 40 so that they spell or otherwise provide the desired message. That message may be the name of a person owning the watch, the name or slogan of a company providing the watch as a promotion, a personal statement like "I love you", or anything else the deemed desirable for display. For example, in the exemplary embodiment shown in FIG. 1 the message displayed within the raceway 40 about the case of the watch 20 comprises the name "LUCY", formed by one "L" insert 42L, one "U" insert 42U, one "C" insert 42C, and one "Y" insert 42Y, interposed between a pair of heart shaped inserts 42'.

The inserts 42 which are located within the raceway are preferably covered by an annular transparent upper bezel 48 (FIG. 3) to enable them to be freely visible therethrough. A similar transparent annular bezel 50 is disposed below the raceway to cover its bottom. The bottom bezel need not be transparent.

Referring now to FIGS. 3 and 4 the details of the raceway 40 will now be discussed. As can be seen therein the raceway 40 basically comprises an inner circular wall 52 and an outer circular wall 54. The outer circular wall is located outside and concentric with the inner circular wall. An annular flange 56 is located midway up the inner circular wall 52 and projects a slight distance radially outward to form a ledge or support surface for the tabs 44 forming the top of the inserts 42 making up the watch's message. A similar annular flange 58 is located midway up the outer circular wall at the same elevation as the flange 56 and projects a slight distance radially inward to form a ledge or support for the tabs 46 forming the bottom of the inserts 42.

Each of the inserts 42 is arranged to be disposed within the raceway 40 with its upper tab(s) 44 being disposed on the inner flange 56 and with its lower tab(s) 46 being disposed on the outer flange 58, so that it can slide along the entire 360 degrees of the raceway. The cooperation of the tabs 44 and 46 and the circular walls 52 and 54, respectively, insure that the inserts are all retained oriented in the same general inwardly radial orientation, i.e., the tops of the characters are directed to the center of the face of the watch, so that the message formed by the inserts is readily readable irrespective of the peripheral position of the message.

If desired the periphery of the upper bezel where it overlies the annular flanges 56 and 58 may be made opaque, e.g., be silverized on its undersurface, so that the upper and lower tabs 44 and 46 of the inserts is not visible through the bezel. Alternatively, other means can be used to obscure the tabs. In fact the raceway may be constructed to include additional flanges above the flanges 56 and 58 to hide the tabs.

As can be seen in FIG. 1 the watch 20 is in the form of a wrist watch. To that end the case top section 24 includes a pair of watch band or strap connectors 60 disposed diametrically from each other to serve as the means for connecting a watch band (not shown) to the watch. It must be pointed out at this juncture that the watch 20 need not be a wrist watch, but can be constructed so that it is suitable for suspension from a necklace to form a pendant watch. Alternatively, the watch may include a pin or other fastening implement so that the watch 20 can be worn on clothing.

Without further elaboration the foregoing will so fully illustrate my invention that others may, by applying current or future knowledge, adapt the same for use under various conditions of service.

I claim:

1. A watch having a face and a case of circular profile surrounding said face, said case including a circular raceway and a plurality of separate decorative inserts, selected ones of said plurality of inserts being shaped to define linguistic elements, said raceway being mounted about the periphery of said face, said inserts being located within said raceway in a predetermined order to establish a predetermined message, said message being slidably mounted in said raceway so that each may be positioned at an point along said periphery.

2. The watch of claim 1 wherein said linguistic elements comprise letters of an alphabet and/or symbols defining a word or concept.

3. The watch of claim 2 wherein the each of said inserts has a profile which constitutes the shape of said letter or said symbol.

4. The watch of claim 1 wherein each of said inserts has a top edge and a bottom edge and wherein said raceway comprises an inner circular wall and an outer circular wall, said outer circular wall being disposed radially outward from said inner circular wall and concentric therewith, each of said inserts being slidable mounted within said raceway between said circular walls, and with said bottom edge of each of said inserts being immediately adjacent said outer circular wall and with said top edge of each of said inserts being immediately adjacent said inner circular wall, whereupon the linguistic elements of said inserts are all oriented in the same general inwardly radial orientation so that the message is readily readable.

5. The watch of claim 3 wherein each of said inserts has a top edge and a bottom edge and wherein said raceway comprises an inner circular wall and an outer circular wall, said outer circular wall being disposed radially outward from said inner circular wall and concentric therewith, each of said inserts being slidable mounted within said raceway between said circular walls, and with said bottom edge of each of said inserts being immediately adjacent said outer circular wall and with said top edge of each of said inserts being immediately adjacent said inner circular wall, whereupon the linguistic elements of said inserts are all oriented in the same general inwardly radial orientation so that the message is readily readable.

6. The watch of claim 1 additionally comprising a transparent bezel disposed over said inserts.

7. The watch of claim 6 additionally comprising a transparent bezel disposed under said inserts.

8. The watch of claim 4 wherein said raceway includes an outer annular flange projecting inward radially from said outer circular sidewall, and an inner annular flange projecting outward radially from said inner circular sidewall, said outer flange being arranged to support said bottom edge of each of said inserts thereon, while said inner flange supports said top edge of each of said inserts thereon.

9. The watch of claim 7 additionally comprising a transparent bezel disposed a predetermined distance above said outer and inner flanges so that said bottom edges of said inserts are located between said outer flange and said bezel, and said top edges of said inserts are located between said inner flange and said bezel.

10. The watch of claim 5 wherein said raceway includes an outer annular flange projecting inward radially from said outer circular sidewall, and an inner annular flange projecting outward radially from said inner circular sidewall, said outer flange being arranged to support said bottom edge of each of said inserts thereon, while said inner flange supports said top edge of each of said inserts thereon.

11. The watch of claim 10 additionally comprising a transparent bezel disposed a predetermined distance above said outer and inner flanges so that said bottom edges of said inserts are located between said outer flange and said bezel, and said top edges of said inserts are located between said inner flange and said bezel.

* * * * *